US008210876B2

(12) United States Patent
Derks et al.

(10) Patent No.: US 8,210,876 B2
(45) Date of Patent: Jul. 3, 2012

(54) CONNECTOR, CONNECTOR ASSEMBLING SYSTEM AND METHOD OF ASSEMBLING A CONNECTOR

(75) Inventors: Erik Geert Henricus Egbertus Derks, Schijndel (NL); Andreas Winandus Dieduksman, 's-Hertogenbosch (NL)

(73) Assignee: FCI, Guyancourt (FR)

( * ) Notice: Subject to any disclaimer, the term of this patent is extended or adjusted under 35 U.S.C. 154(b) by 194 days.

(21) Appl. No.: 12/227,622

(22) PCT Filed: May 23, 2007

(86) PCT No.: PCT/EP2007/055027

§ 371 (c)(1),
(2), (4) Date: Mar. 21, 2011

(87) PCT Pub. No.: WO2007/135180

PCT Pub. Date: Nov. 29, 2007

(65) Prior Publication Data

US 2011/0165798 A1 Jul. 7, 2011

(51) Int. Cl.
*H01R 13/648* (2006.01)

(52) U.S. Cl. ..... 439/607.06

(58) Field of Classification Search . 439/607.05–607.07
See application file for complete search history.

(56) References Cited

U.S. PATENT DOCUMENTS

| | | | | |
|---|---|---|---|---|
| 5,634,822 | A * | 6/1997 | Gunell | 439/668 |
| 6,602,095 | B2 * | 8/2003 | Astbury et al. | 439/607.07 |
| 6,652,318 | B1 * | 11/2003 | Winings et al. | 439/607.07 |
| 6,709,298 | B2 * | 3/2004 | Bradley | 439/701 |
| 7,371,117 | B2 * | 5/2008 | Gailus | 439/607.08 |
| 7,736,182 | B2 * | 6/2010 | Pan | 439/607.07 |
| 7,775,802 | B2 * | 8/2010 | Defibaugh et al. | 439/65 |
| 7,841,900 | B2 * | 11/2010 | Liu et al. | 439/607.07 |
| 7,967,638 | B1 * | 6/2011 | Kline et al. | 439/607.07 |

FOREIGN PATENT DOCUMENTS

| | | | |
|---|---|---|---|
| WO | WO 04/001907 | A1 | 12/2003 |
| WO | WO 2006/002793 | A1 | 1/2006 |

* cited by examiner

*Primary Examiner* — Gary F. Paumen
(74) *Attorney, Agent, or Firm* — Harrington & Smith

(57) ABSTRACT

An electrical connector is presented, including a plurality of connector wafers coupled by a coupling piece, each wafer including a housing accommodating a plurality of contact elements, said housing having opposite side edges, an insertion side exposing the contact elements, a back side and opposite main faces. The connector wafers are provided with first coupling means extending along at least a portion of a side edge thereof. The coupling piece is provided with second coupling means extending along at least a portion thereof. The first and second coupling means are arranged for engaging each other, in a coupled situation, on a plurality of distinct engagement positions along the respective coupling means.

15 Claims, 9 Drawing Sheets

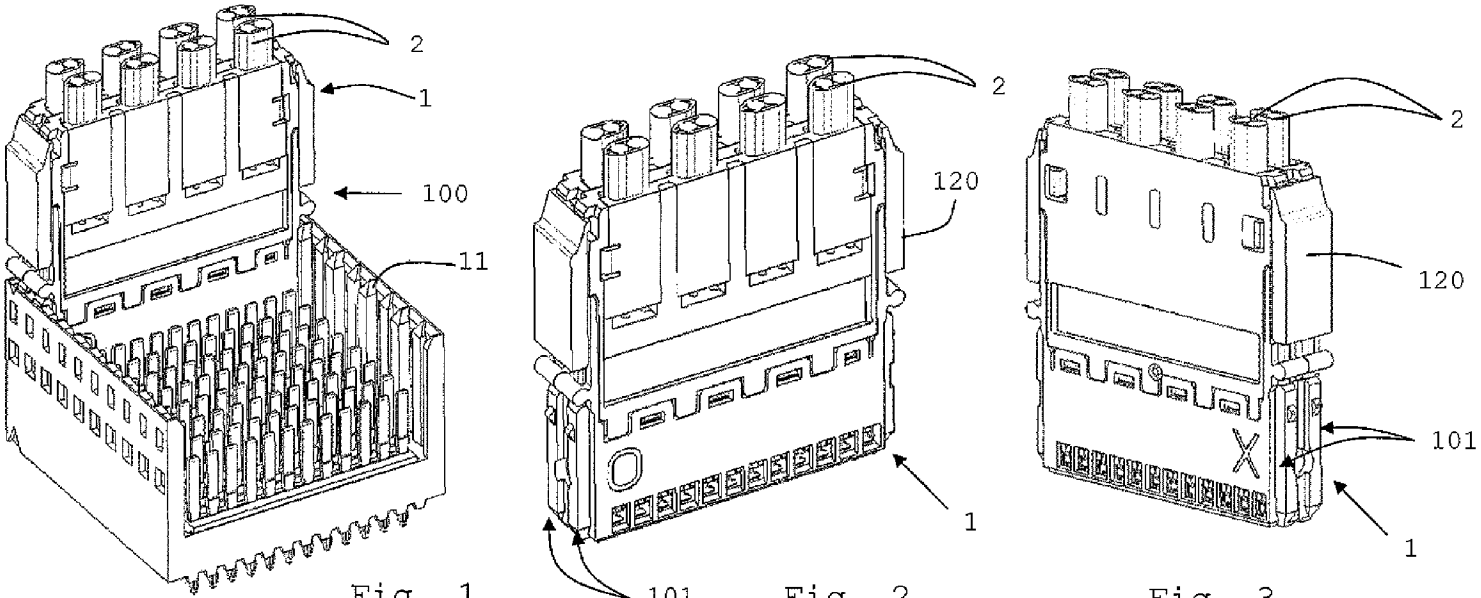
Fig. 1
Fig. 2
Fig. 3
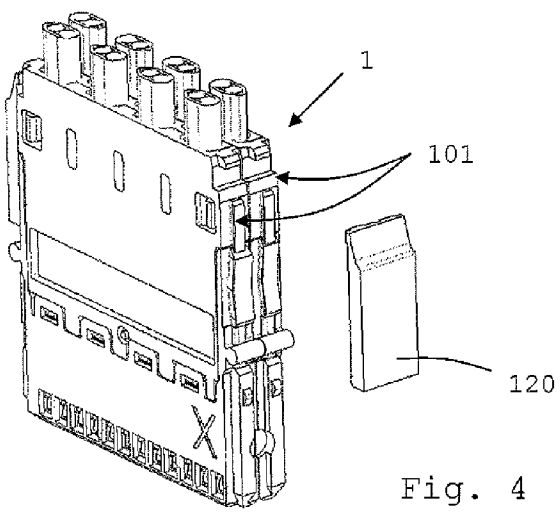
Fig. 4
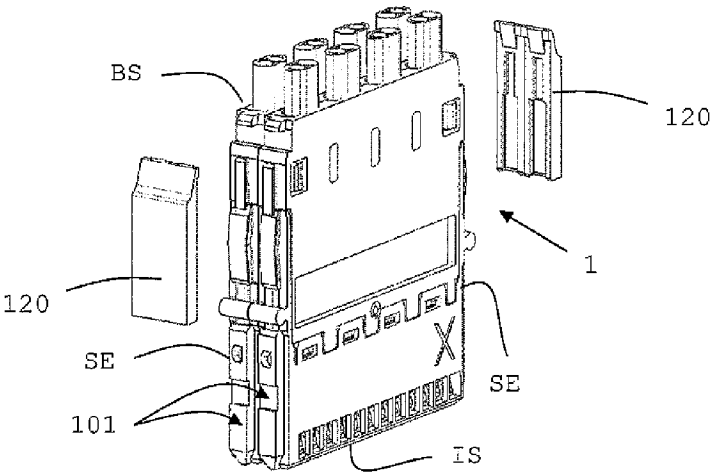
Fig. 5

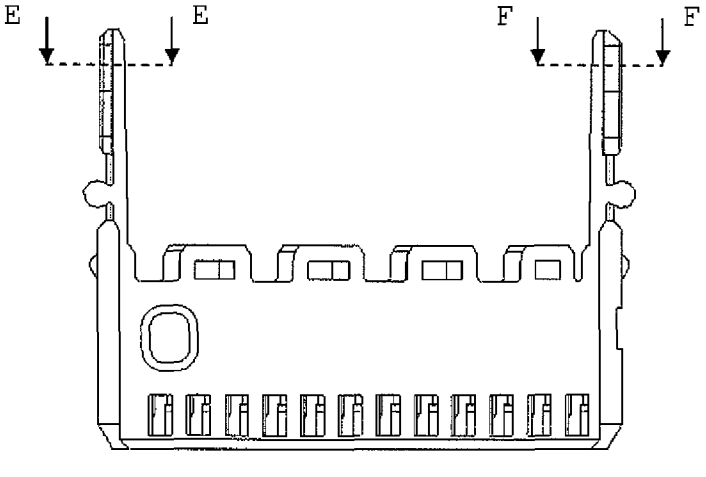
Fig. 20D
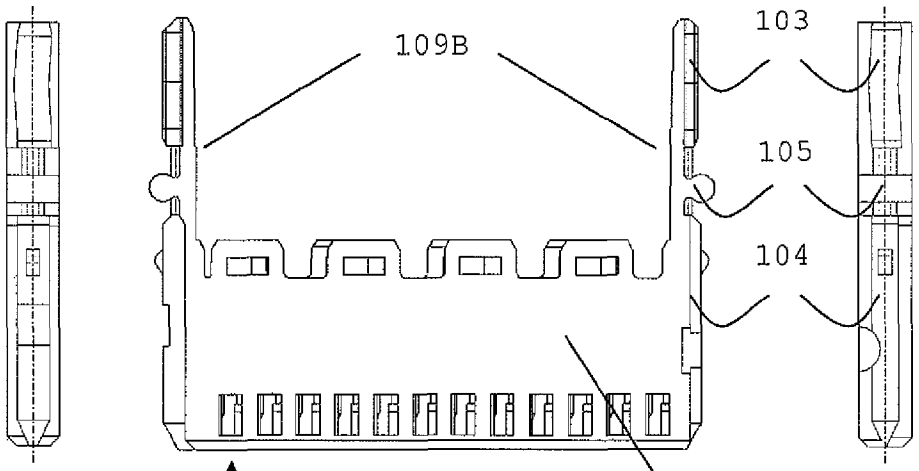
Fig. 20C
Fig. 20B
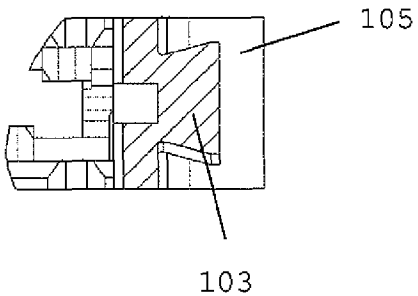
Fig. 20F
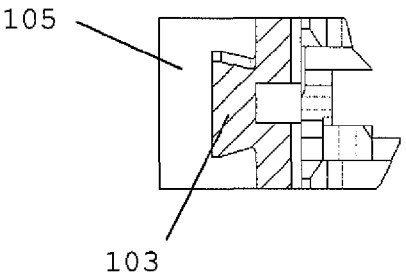
Fig. 20E
Fig. 20A

CONNECTOR, CONNECTOR ASSEMBLING SYSTEM AND METHOD OF ASSEMBLING A CONNECTOR

FIELD OF THE INVENTION

The present invention relates to an electrical connector and, more particularly, to an electrical connector comprising a plurality of connector wafers coupled by a coupling piece.

BACKGROUND

There is a continuing strive for smaller electrical connectors which may be manufactured cost-effectively, while being capable of transmitting high speed signals.

A suitable connector comprises a plurality of connector wafers coupled by a coupling piece, each wafer comprising a housing accommodating a column of contact elements. The housing may have opposite side edges, an insertion side exposing the contact elements, a back side and opposite main faces. The connector wafers may be provided with first coupling means extending along at least a portion of a side edge thereof, and the coupling piece may be provided with second coupling means extending along at least a portion thereof. Such a connector is known from WO 2006/002793, the contents of which are hereby incorporated by reference in its entirety.

Such a connector may have a relatively small size and may be assembled to comprise a desired number of aligned contacts by selecting the number of coupled connector wafers. By choosing an appropriate relative positioning of adjacent connector wafers the connector may be rendered especially suitable for transmitting high speed signals with relatively high signal integrity, e.g. with relatively low cross talk.

However, small variations in the relative positions of (adjacent) wafers which e.g. result in variations of the (transverse) separation of the aligned contact elements, may have a strong and undesirable influence on the transmission characteristics of the connector, in particular for high speed signals. Such variations may be due to play between the wafers and the coupling piece or coupling pieces, e.g. caused by tolerances which are required for manufacturing and assembly. Such play between the connector parts may also render the connector relatively fragile.

Consequently, there is a need for an improved connector of the aforementioned kind reducing the shortcomings of the prior art.

SUMMARY

In one aspect, the first and second coupling means are arranged for engaging each other, in a coupled situation, on a plurality of distinct positions along the respective coupling means.

The number and positions of these engagement portions and the force with which the coupling means engage each other determine the relative fixation of the connector wafer and the coupling piece, as well as the force required for assembly of the parts. In this way, interference is created between the coupling means of the connector wafer and the coupling piece and an appropriate lining up of the different wafers may be achieved, e.g. positioning adjacent wafers substantially parallel to each other. At the same time, assembly of a connector may be facilitated since sources of friction during coupling by sliding the coupling means with respect to each other are limited to the individual engagement portions.

The arrangement of separate engagement positions, realising interference points or interference areas, determines the total engagement force and the relative alignment of the coupled parts. The arrangement may thus be selected according to different requirements. Relatively large manufacturing tolerances may be allowed without altering the engagement force and surfaces substantially.

Thus, an improved true position of several wafers or all wafers and a more robust connector may be provided.

Claim 2 defines an embodiment wherein the engagement positions and their engagement force are defined by the shape of the opening of the slot or slots on the coupling piece, allowing to improve a connector using prior art wafers.

Claim 3 defines an embodiment wherein the engagement positions and their engagement force are defined by the shape of the coupling ridge of the connection wafer, allowing to assemble an improved connector using prior art coupling pieces. The extending portions may extend substantially parallel to the side edge, to further assist defining the true positioning of the wafer. The extending portions may be on either one or both edges of the ridge.

In the embodiment of both claims 2 and 3 the coupling piece may be coupled to the ridge of the connector wafers by sliding. This assists in defining an essentially parallel orientation of the respective connector wafers. The engagement positions and engagement force are determined by the respective transversally extending portions.

Claim 4 defines an embodiment wherein the material of the coupling ridge provides additional lateral support to the portions of the ridge at the engagement positions as well as provides a certain amount of guidance to the coupling piece during the coupling action. The angled section may have a generally arrow head shape.

Claim 5 defines a suitable arrangement of the extending portions in an embodiment of claim 2, 3 or 4. The arrangement of three engagement positions on alternating sides in respect to the longitudinal axis provides a relatively good alignment with minimum engagement positions, which may reduce a friction force during coupling by sliding the coupling piece and the connector wafer onto each other.

With a connector according to claim 6 the first and second coupling means are held together in a direction parallel to the main faces.

A connector according to claim 7 may be assembled to a particular contact element arrangement in a reliable manner from a number of otherwise substantially identical parts. Useful and efficient ways of providing polarisation and/or coding means are forming the connection means with different sizes and/or positions.

A connector according to claim 8 provides an additional degree of freedom in arranging contact elements within the connector and allows a cost efficient manufacturing of the connector, e.g. using a single design of a relatively complex insert molded lead frame assembly (IMLAs) and different relatively simple housing pieces.

In a connector according to claim 9 the coupling means may provide the desired relatively tight coupling between the coupling piece and the housing piece. The ridge on the IMLA may serve for additional coupling and/or positioning of the IMLA. It may further assist guiding the coupling piece, e.g. during assembly of the connector.

In another aspect a connector is provided, which comprises a plurality of connector wafers coupled by a coupling piece having a coupling ridge which comprises a section with an angle in it, e.g. having a generally arrow head shape, with respect to the longitudinal axis, arranged for engaging a coupling slot of the coupling piece, in a coupled situation, on a plurality of distinct engagement positions along the angled section. Each wafer comprises a housing accommodating a plurality of contact elements, said housing having opposite side edges, an insertion side exposing the contact elements, a back side and opposite main faces, wherein the connector wafers are provided with a coupling ridge the connector wafers being provided with a coupling ridge extending along at least a portion of a side edge of the connector wafer and oriented along a longitudinal axis substantially in the direction from the insertion side to the back side. The coupling piece is provided with corresponding coupling slots extending along at least a portion thereof.

Such a connector may efficiently be assembled to form a connector comprising a plurality of connector wafers and being suitable for high speed signals. A relatively robust connector is provided in case the coupling piece comprises a number of coupling slots equal to the desired number of connector wafers, and in particular if the connector wafers are provided with angled sections on both sides thereof and both sides being coupled by coupling pieces.

In another aspect, an electrical connector is provided comprising a plurality of connector wafers coupled by a coupling piece. Each wafer comprises a housing accommodating a column of contact elements, said housing having opposite side edges, an insertion side exposing the contact elements, a back side and opposite main face. The connector wafers are provided with first coupling means extending along at least a portion of a side edge thereof and extending along a longitudinal axis substantially in the direction from the insertion side to the back side. The coupling piece is provided with second coupling means extending along at least a portion thereof. The connecting wafer comprises an insert molded leadframe assembly (IMLA) and a housing piece, at least the housing being provided with the first coupling means extending along at least a portion of a side edge thereof and comprising a section with an angle in it, e.g. having a generally arrow head shape, with respect to the longitudinal axis, arranged for engaging a coupling slot of the coupling piece, in a coupled situation, on a plurality of distinct positions along the angled section.

Thus, a modular connector is provided which may be assembled relatively cost-efficient to a relatively robust connector suitable for transmitting high speed signals with relatively high signal integrity.

BRIEF DESCRIPTION OF THE DRAWINGS

FIG. 1 shows a perspective view of an embodiment of an electrical connection system.

FIG. 2 shows a view of a connector comprising two connector wafers with two coupling pieces attached.

FIG. 3 shows another view of a connector comprising two connector wafers with two coupling pieces attached.

FIG. 4 shows a view of a connector comprising two connector wafers with two coupling pieces, one attached and one detached.

FIG. 5 shows another view of a connector comprising two connector wafers with two coupling pieces, both detached.

FIGS. 20A-20F show several views of a housing piece for a connector wafer.

DETAILED DESCRIPTION OF EMBODIMENTS

Figure 10:
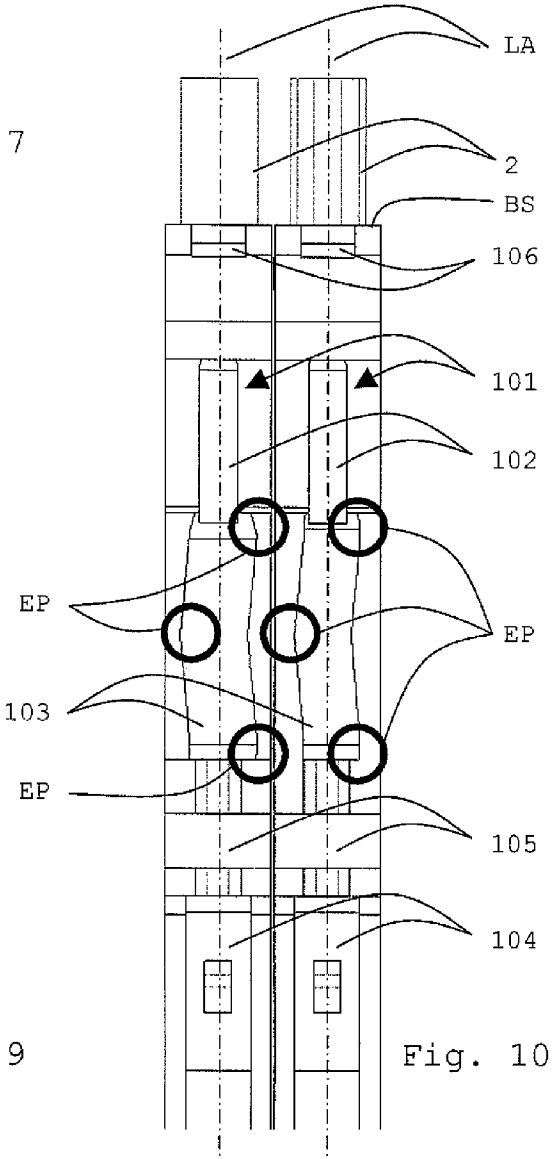
FIG. 10 shows a partial side view of two connector wafers with the engagement positions indicated.
Figure 7:
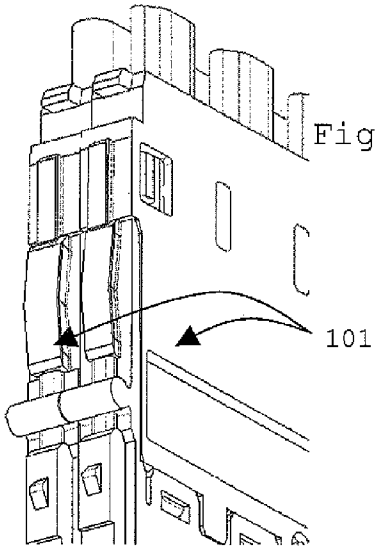
FIGS. 6-9 show several partial views in perspective of two connector wafers.
Figure 9:
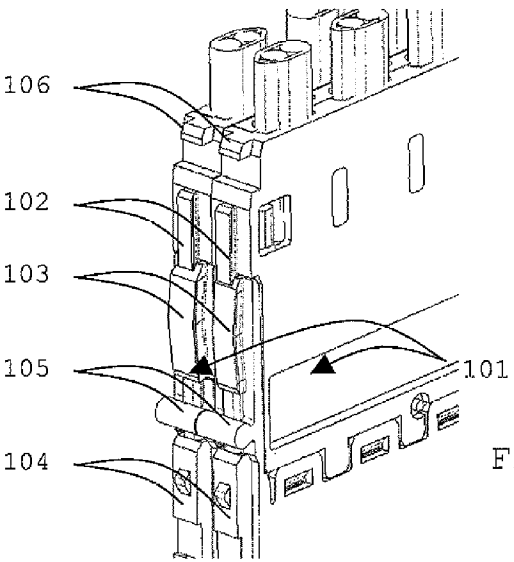
Figure 6:
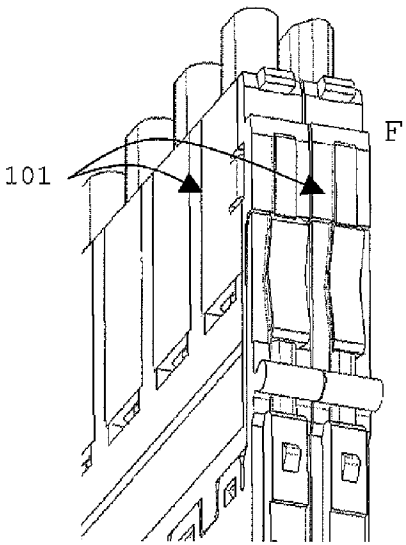
Figure 8:
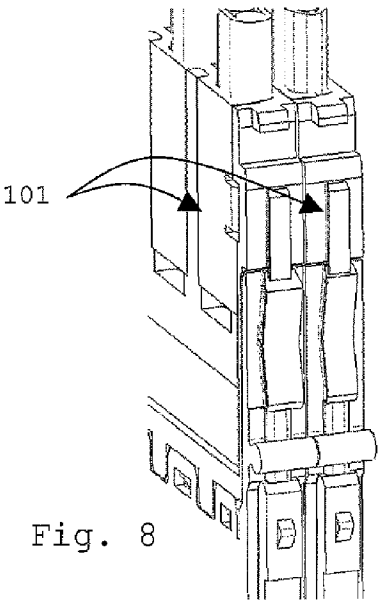

Referring to FIG. 1, there is shown a perspective view of an electrical connection system 100 comprising a connector 1, in the present case a cable connector, and a counter connector or header 11. The electrical connection system 100 generally comprises the connector 1 having a wafer 101 for connecting cables 2 to another electrical component (not shown) such as a printed circuit board for example. The connection wafer 101 is adapted to be plugged into the counter connector 11. The shown counter connector 11 is adapted for receiving up to ten wafers 101, but the connector 11 could be adapted to receive any desired number of connector wafers 101, e.g. two or twenty.

FIGS. 2-5 show various views of a connector 1 comprising two adjacent wafers 101 with and without coupling pieces 120 attached. Each wafer 101 comprises a housing accommodating a plurality of contact elements (not shown), said housing having opposite side edges SE, an insertion side IS exposing the contact elements, a back side BS and opposite main faces. In the shown embodiment, the contact elements are arranged in a column.

As shown in FIGS. 4 and 5 and more clearly in FIGS. 6-10, the wafers 101 are provided with coupling means formed as a coupling ridge 102, 103 on both side edges of the connector wafers 101 and extending along a longitudinal axis LA substantially in the direction from the insertion side IS to the back side BS. The side edges SE are further provided with coupling ridges 104 near the insertion side IS, pivots 105 and locking protrusions 106 near the back side BS.

The coupling ridge comprises a first substantially straight section 102 and a curved or angled section 103 with an angle in it with respect to the longitudinal axis LA. In the shown embodiment each angled section 103 has a general arrow head shape, 3 apexes of which shown in circles in FIG. 10 define engagement portions EP. Thus, the apexes of the angled section 103 form, on both of its edges, engagement portions EP extending transversally, and substantially parallel to the side edge SE, relatively further from the longitudinal axis LA than another portion of that edge. In the shown embodiment, the apexes of the arrow head shape define a substantially triangular arrangement of the engagement portions EP. Here, the triangular arrangement is that of a substantially isosceles triangle.

The coupling ridge sections 102 and 103 have different sizes. Sections 103 of adjacent wafers 101 have a different width and height with respect to the longitudinal axis LA and the side edge SE, thus serving as polarisation and coding means for different wafers 101. This allows to reliably assemble a connector 1 with different arrangements or positions of contact elements. Different wafers 101 may also be optically marked for user convenience, e.g. with symbols "X" and "O" as in FIGS. 2-5.

The wafer 101 may also be provided with further optional coupling ridges 104, for guiding and/or coupling a wafer 101 to corresponding slots in counter connector 11. The counter connector 11 and one or more wafers 101 may be coupled and/or locked to the counter connector 11. For this, the wafer 101 may be provided with protrusions, preferably formed onto the optional ridge 104 as shown in the Figures. Such protrusions can be fitted into corresponding receiving slots located in the side walls of the counter connector 11.

Figure 15:
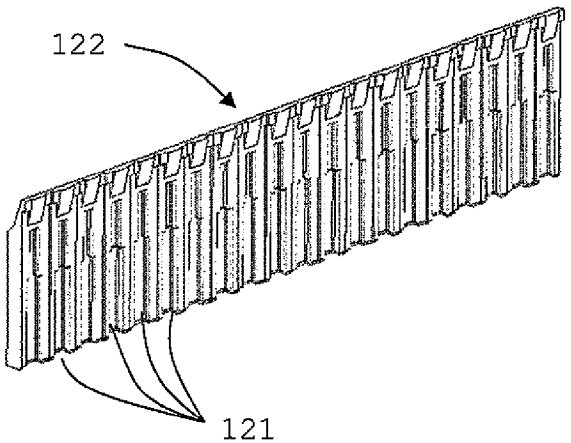
FIG. 15 shows a coupling piece provided with twenty coupling slots.
Figure 12:
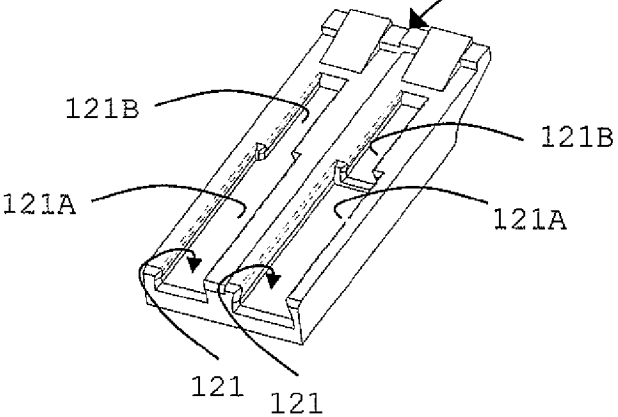
FIGS. 11-14 show several views of a coupling piece provided with two coupling slots.
Figure 14:
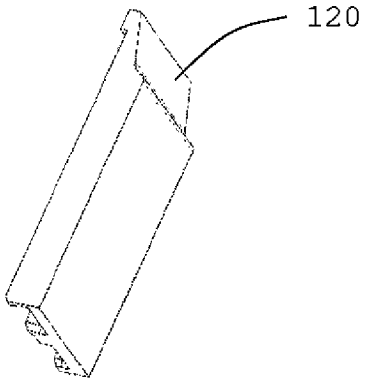
Figure 11:
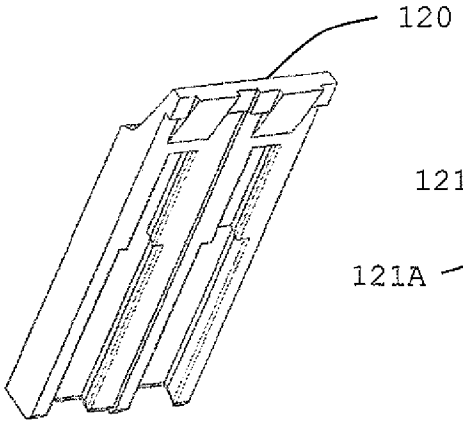
Figure 13:
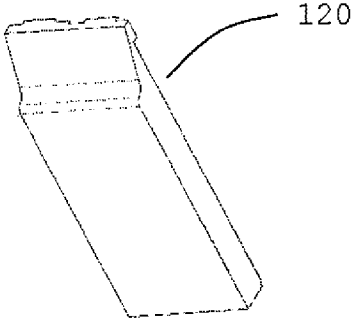

FIGS. 11-14 show various perspective views of a coupling piece 120, or stack 120, having two coupling slots 121 extending along a portion of the coupling piece 120. Each of the coupling slots 121 comprises a relatively wide section 121A and a relatively narrow section 121B. FIG. 15 shows a coupling piece 122 which is substantially similar to coupling piece 120 but comprising twenty coupling slots 121, of which four are indicated. Similarly, coupling pieces with any desired number of coupling slots, e.g. ten, may be provided.

The coupling slot sections 121A, 121B are adapted to receive respectively a corresponding section 103, 102 of a coupling ridge of a connector wafer 101. The coupling ridges and corresponding coupling slots have a substantially matching dovetail-shaped cross-section throughout their full respective lengths. One or more portions of either or both coupling means may have another cross section, e.g. substantially straight or rounded.

Figure 16C:
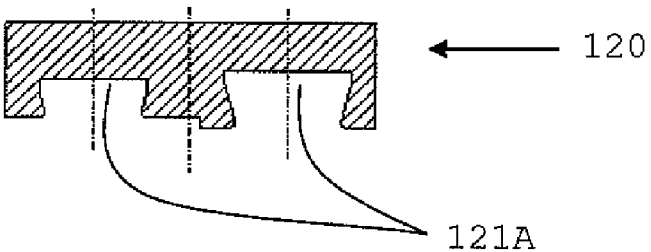
FIGS. 16A-16D show a coupling piece as well as a detail and cross sectional views thereof.
Figure 16D:
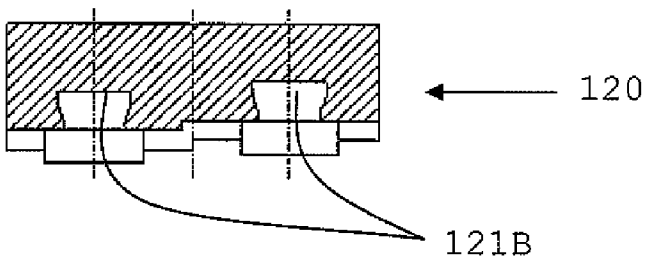
Figure 16A:
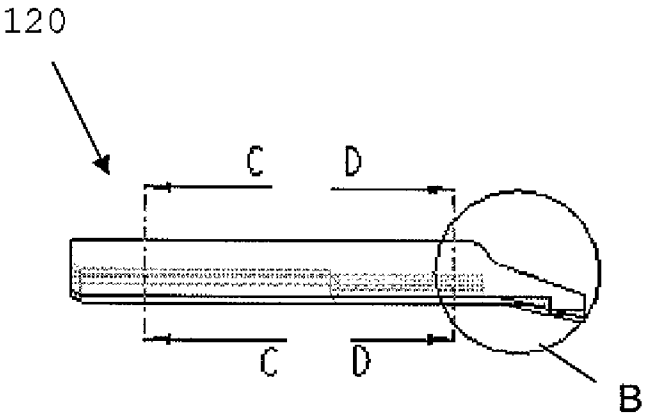
Figure 16B:
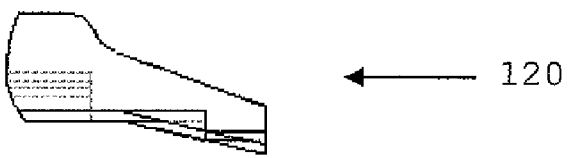
Figure 17D:
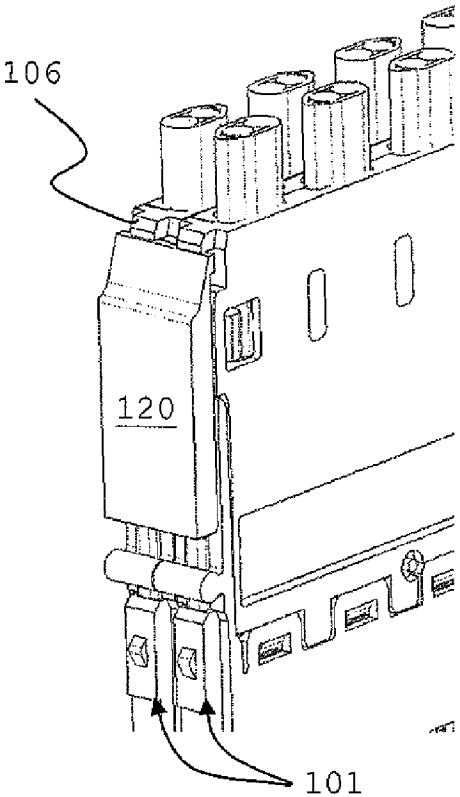
FIGS. 17A-17D show a method of coupling of two connector wafers with a coupling piece.
Figure 17C:
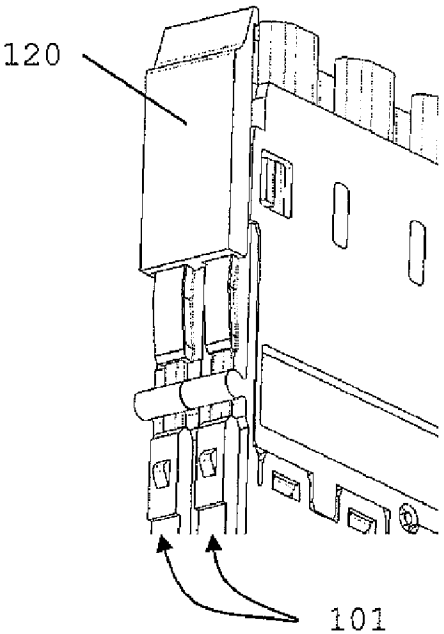
Figure 17B:
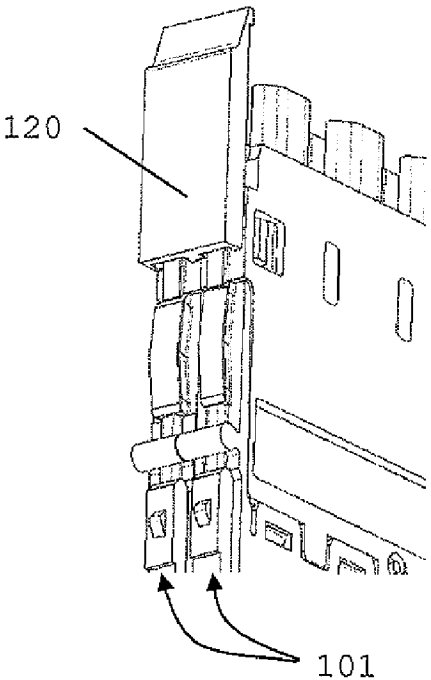
Figure 17A:
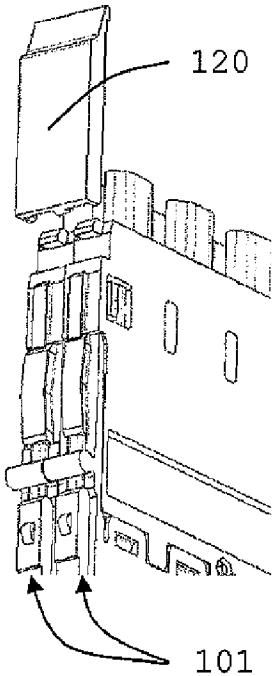

FIGS. 16A-16D show various views and details of a coupling piece 120. A larger coupling piece such as coupling piece 122 may exhibit the same features shown in FIGS. 16A-16D. FIG. 16B shows a detail of the back side end of the coupling piece, as indicated in FIG. 16A. FIGS. 16C, 16D show cross section views through coupling slots 121A and 121B, respectively, as indicated in FIG. 16A. FIGS. 16C, 16D show the dovetail shape of the opening, with a relatively narrow opening and a relatively wider cross section further inward. Further, different sizes and positions of adjacent coupling slots 121A, 121B corresponding to different wafers 101 and/or different positions thereof are visible.

FIGS. 17A-17D show a method of coupling two wafers 101 with a coupling piece 120 by moving the coupling piece 120 and the wafers 101 relative to each other, thus sliding the coupling piece 120 over the coupling ridges 102, 103 of the wafers 101. The coupling means 102, 103 and 121 of the shown embodiments engage each other, in a coupled situation, substantially along the full length of the coupling ridge section 102 and on a plurality of distinct engagement positions EP along the coupling ridge section 103. For securing the coupling piece 120 to the wafer 101, a, possibly extending, portion of the back side rim of the coupling piece 120 may latch or snap behind the locking protrusion 106 situated at the back side BS end of the side edge SE as shown e.g. in FIG. 17D. The coupling may be performed with one or more wafers at a time. Chamfered or bevelled edge corners on the ridges 102, 103 and on the coupling pieces may facilitate coupling by sliding.

A coupling piece 120 may also be pressed onto the wafer 1 substantially perpendicular to the side edges SE, so that the coupling means are coupled with a snap-fit due to the dovetail shape.

Figure 18:
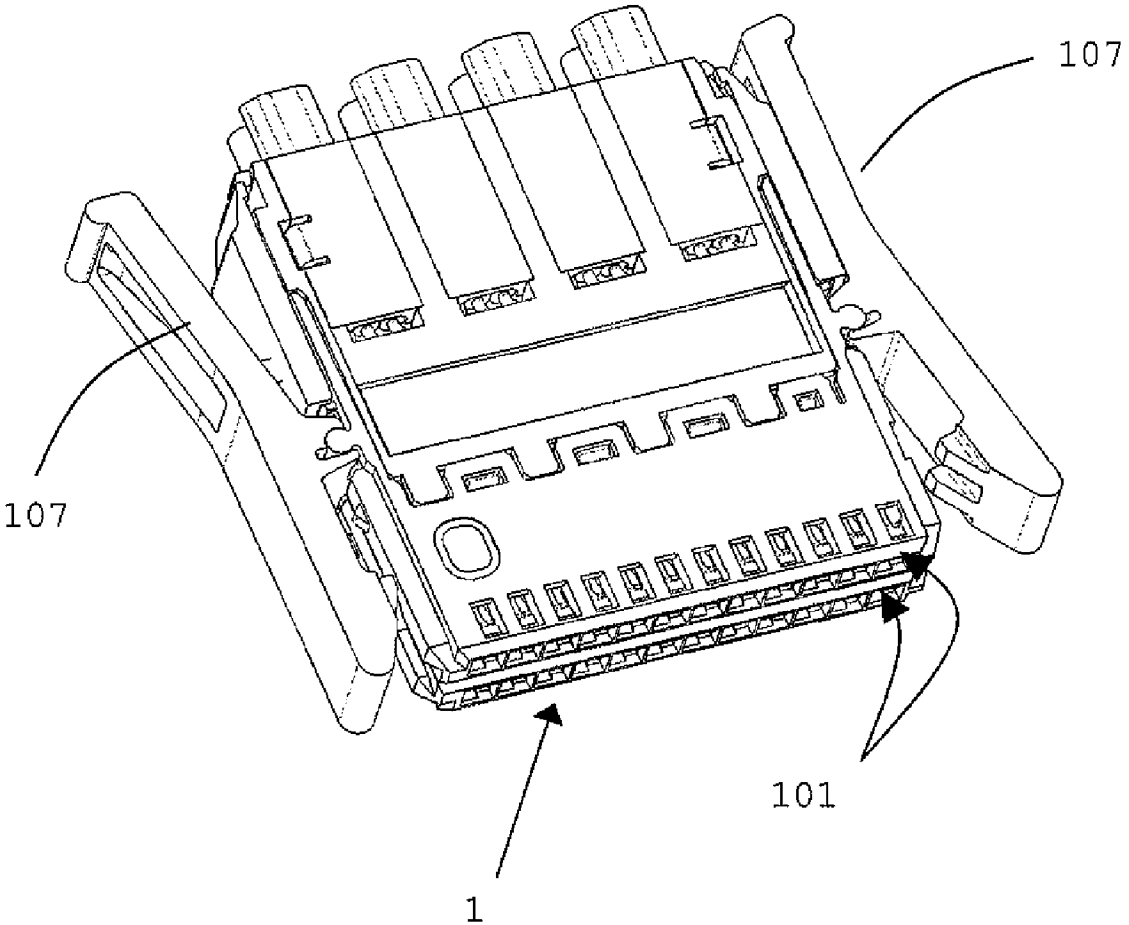
FIG. 18 shows a connector comprising two connector wafers and being provided with latches.

Connector wafers 101 may be provided with latches 107 hingedly mounted onto the pivots 105, as indicated in FIG. 18 which shows a connector 1 comprising two connector wafers 101 and two latches 107.

Figure 19B:
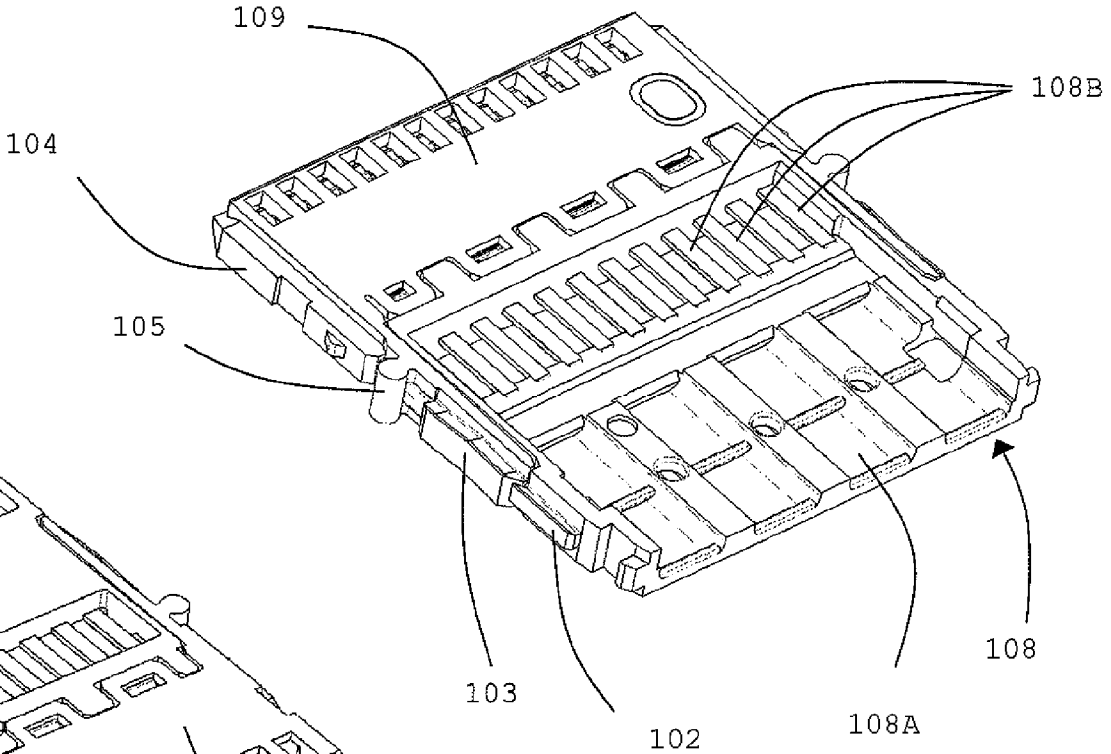
FIGS. 19A-19B show views of a modular connector wafer.
Figure 19A:
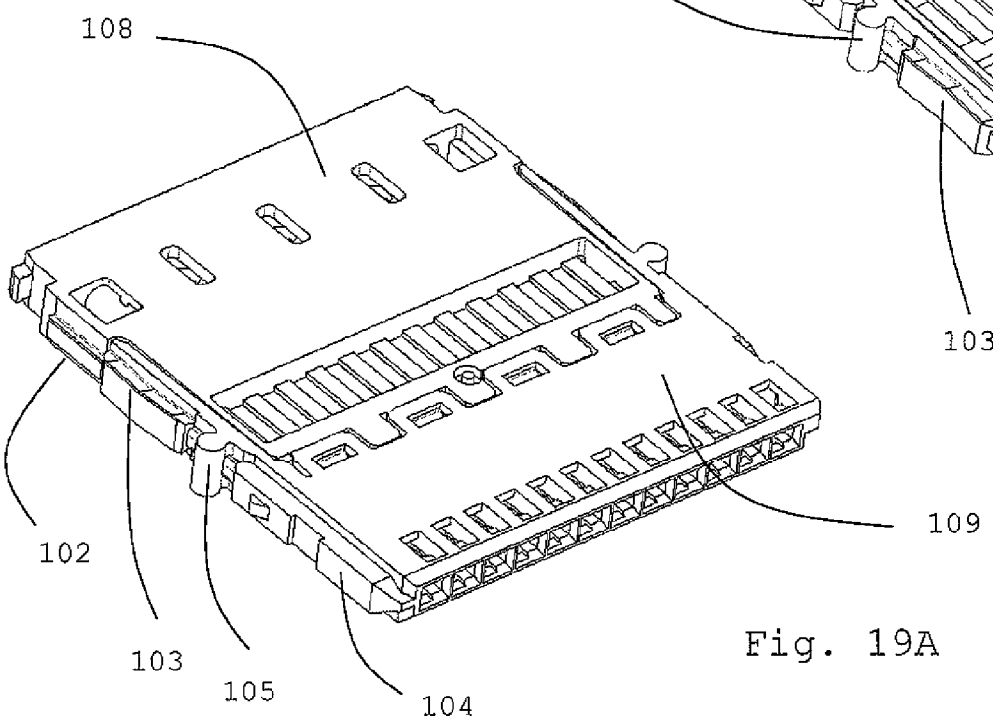

In all shown embodiments and as indicated in some detail in FIGS. 19A-19B, the wafers 101 are modular and comprise an IMLA 108 connected with and attached to a housing piece 109. The coupling ridges 102 are part of the IMLA. The coupling ridges 103 and 104 are part of the housing pieces 109. The pivots 105 are also part of the housings 109.

IMLAs as such are known. The shown IMLAs 108 are modular, comprising an IMLA housing part 108A having a column of contact elements 108B, of which three are indicated in FIG. 19B. The IMLAs further comprise a number of other parts (not shown in FIGS. 19A-19B) for fixing and contacting the cables 2 to the contact elements 108B and the IMLA housing part 108A.

FIGS. 20A-20F show various views of a housing piece 109 without an IMLA attached. The housing piece 109 comprises a main body 109A and cantilever arms 109B extending on either side of the main body 109A and providing a portion of the side edges SE of the wafer 101. The ridges 103 are arranged on the arms 109B, the ridges 104 on the main body 109A. FIGS. 20E, 20F show perpendicular cross sections through the arms 109B, as indicated in FIG. 20D. FIGS. 20A-20F show that the dovetail shaped ridges 103 are sized differently on each side edge SE for polarisation and/or coding purposes.

Different housing pieces 109 may hold identical IMLAs 108 in a different position relative to the housing piece 109. In the shown embodiments the housing pieces 109 serve for ascertaining positioning, coding and polarisation of the wafers 101, and thus, through the IMLAs 108, for aptly positioning the contact elements 108B within the connector 1.

Figure 21B:
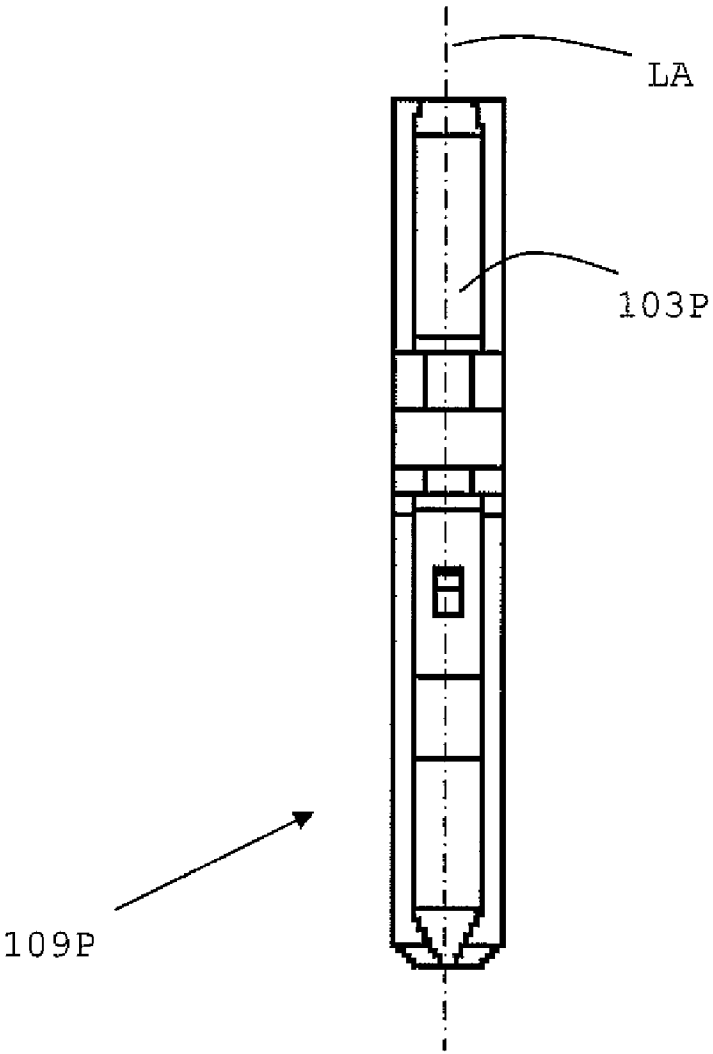
FIG. 21A-21B show a side view of a prior art connector housing piece with substantially straight coupling ridges.
Figure 21A:
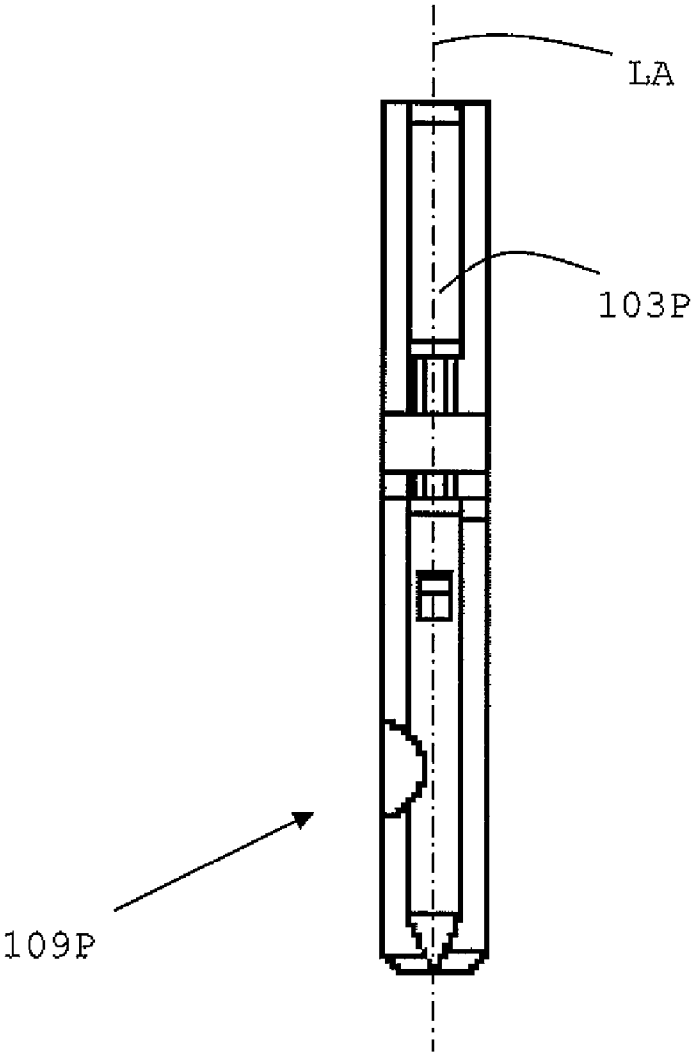

FIG. 21A-21B show a housing piece of a prior art wafer according to WO 2006/002793. This wafer is also modular and comprises an IMLA attached to a prior art housing part 109P, of which side views are shown in FIGS. 21A-21B. The IMLA may be substantially identical to the IMLAs 108. The coupling ridges 103P of housing pieces 109P are essentially straight with respect to the longitudinal axis LA.

Wafers comprising a housing part 109P are held more securely with a novel coupling piece, the coupling slot of which has an edge with one or more portions extending further into the slot than another portion of that edge, provides a plurality of engagement portions along the coupled coupling ridge and coupling slot. Thus, coupling a number of wafers may be facilitated while the coupled wafers may be securely held in a particular relative positions, which may be parallel. In sum, a relatively robust connector suitable for high speed signals may efficiently be assembled from separate parts to a desired arrangement of contact elements. Any or all parts of the connector or sub-assemblies thereof, such as connector wafers or IMLAs, may be provided individually or as a kit for assembling such connector.

Within this text, the expression "dovetail projection" is meant to describe any shape which comprises a portion with a cross section having a relatively small width near the surface or object from which the projection extends (here, e.g. a wafer) and a relatively large width further away from the object, such as a projection formed with an essentially trapezoidal, heart, diamond or (semi-)circular shape, preferably being substantially symmetric. The expression "dovetail-shaped opening" or "-slot" is to be construed equivalently, e.g. a slot with a relatively narrow mouth and a relatively larger open width further inwards.

Although only exemplary embodiments are discussed and shown in the drawings, it should be understood that many alternate forms of embodiments lie within the scope of the claims. In addition, any suitable size, shape or type of elements or materials could be used.

For instance, the coupling pieces 120 may not only be used for coupling several connector wafers 101 or several connector wafers 101P, but also for connecting connector wafers of both types together.

The coupling ridge having distinct engagement portions may also be provided on IMLAs. This allows to directly couple the IMLAs which may provide a relatively robust connector. Optional housing pieces may then be provided with different coupling or coding means, and/or substantially straight ridges, and/or no coupling, polarisation and/or coding means at all.

The invention claimed is:

1. Electrical connector, comprising a plurality of connector wafers coupled by a coupling piece, each wafer comprising a housing accommodating a plurality of contact elements, said housing having opposite side edges, an insertion side exposing the contact elements, a back side and opposite main faces, the connector wafers being provided with first coupling means extending along at least a portion of a side edge thereof, wherein the coupling piece is provided with second coupling means extending along at least a portion thereof, wherein the first and second coupling means are arranged for engaging each other, in a coupled situation, on a plurality of distinct, spaced transverse engagement portions along a first coupling ridge, the number and the positions of which along the respective coupling means determine the relative fixation as well as the force required for assembly of the connector wafer and the coupling piece.

2. Connector according to claim 1, wherein the first coupling means are provided as the first coupling ridge on one or both side edges of the connector wafer and extending along a longitudinal axis substantially in the direction from the insertion side to the back side, and wherein the second coupling means are provided as a coupling slot adapted to receive the coupling ridge, the coupling slot having at least one edge with one or more portions extending further into the slot than another portion of that edge.

3. Connector according to claim 1, wherein the first coupling means are provided as the first coupling ridge on one or both side edges of the connector wafer and extending along a longitudinal axis substantially in the direction from the insertion side to the back side, and wherein the second coupling means are provided as a coupling slot adapted to receive the connector wafer coupling ridge, the coupling ridge having at least one edge with one or more portions which extend transversally relatively further from the longitudinal axis than another portion of that edge.

4. Connector according to claim 3, wherein the first coupling ridge comprises a section with an angle in it with respect to the longitudinal axis.

5. Connector according to claim 2, wherein the first and second coupling means engage each other, in a coupled situation, on at least three distinct portions, one first portion being arranged on one side of the longitudinal axis and a second and third portion being arranged on the opposite side of the longitudinal axis and on either side of the first portion along the longitudinal axis.

6. Connector according to claim 1, wherein the first coupling ridge and a corresponding coupling slot have a dovetail-shaped cross-section perpendicular to the longitudinal axis throughout at least a portion of their respective lengths.

7. Connector according to claim 1, wherein the first and/or the second coupling means are provided with polarisation and/or coding means.

8. Connector according to claim 1, wherein the connector wafer comprises an insert molded leadframe assembly and a housing piece, at least one of which being provided with the first coupling means.

9. Connector according to claim 8, wherein the insert molded leadframe assembly is provided with the first coupling ridge as an essentially straight coupling ridge with respect to the longitudinal axis and the housing piece is provided with a coupling ridge comprising a section with an angle in it with respect to the longitudinal axis.

10. Connector wafer presenting the features of the connector wafer disclosed in claim 1.

11. Coupling piece presenting the features of the coupling piece disclosed in claim 1.

12. Connector wafer housing piece presenting the features of the connector wafer housing piece disclosed in claim 8.

13. Kit for assembling a connector according to claim 1, comprising one or more coupling pieces and a plurality of connector wafers and/or a plurality of insert molded leadframe assemblies and connector wafer housing pieces.

14. Electrical connector, comprising a plurality of connector wafers coupled by a coupling piece, each wafer comprising a housing accommodating a plurality of contact elements, said housing having opposite side edges, an insertion side exposing the contact elements, a back side and opposite main faces, the connector wafers being provided with a coupling ridge extending along at least a portion of a side edge thereof and oriented along a longitudinal axis substantially in the direction from the insertion side to the back side, wherein the coupling piece is provided with corresponding coupling slots extending along at least a portion thereof, wherein the coupling ridge comprises a section with a transverse angle in it with respect to the longitudinal axis, arranged for engaging a coupling slot of the coupling piece, in a coupled situation, on a plurality of distinct portions along the angled section.

15. Electrical connector, comprising a plurality of connector wafers coupled by a coupling piece, each wafer comprising a housing accommodating a column of contact elements, said housing having opposite side edges, an insertion side exposing the contact elements, a back side and opposite main faces, the connector wafers being provided with first coupling means extending along at least a portion of a side edge thereof and extending along a longitudinal axis substantially in the direction from the insertion side to the back side, wherein the coupling piece is provided with second coupling means extending along at least a portion thereof, wherein the connecting wafer comprises an insert molded leadframe assembly and a housing piece, at least the housing piece being provided with the first coupling means extending along at least a portion of a side edge thereof and comprising a coupling ridge section with a transverse angle in it with respect to the longitudinal axis, arranged for engaging a coupling slot of the coupling piece, in a coupled situation, on a plurality of distinct portions along the angled section.

* * * * *